US008858650B2

(12) United States Patent
Scepanski

(10) Patent No.: US 8,858,650 B2
(45) Date of Patent: Oct. 14, 2014

(54) BLEACHING METHODS WITH PEROXY COMPOUNDS

(75) Inventor: William Scepanski, Bloomington, MN (US)

(73) Assignee: Sunburst Chemicals, Inc., Bloomington, MN (US)

( * ) Notice: Subject to any disclaimer, the term of this patent is extended or adjusted under 35 U.S.C. 154(b) by 526 days.

(21) Appl. No.: 12/172,563

(22) Filed: Jul. 14, 2008

(65) Prior Publication Data

US 2009/0165214 A1 Jul. 2, 2009

Related U.S. Application Data

(60) Provisional application No. 61/009,544, filed on Dec. 27, 2007.

(51) Int. Cl.

| | |
|---|---|
| ***D06L 1/02*** | (2006.01) |
| ***C11D 3/39*** | (2006.01) |
| ***C11D 3/395*** | (2006.01) |
| ***C11D 3/32*** | (2006.01) |
| ***D06L 3/02*** | (2006.01) |

(52) U.S. Cl.

CPC ..... *D06L 3/021* (2013.01)
USPC ..... 8/111; 510/303; 510/313; 510/501; 510/505; 510/302

(58) Field of Classification Search

USPC ..... 510/302, 303, 313, 501, 505; 8/111
See application file for complete search history.

(56) References Cited

U.S. PATENT DOCUMENTS

| | | | | |
|---|---|---|---|---|
| 4,430,243 | A * | 2/1984 | Bragg | 510/311 |
| 4,624,713 | A | 11/1986 | Morganson et al. | |
| 4,776,972 | A * | 10/1988 | Barrett | 252/186.38 |
| RE32,818 | E | 1/1989 | Fernholz et al. | |
| 4,846,993 | A | 7/1989 | Lentsch et al. | |
| 6,340,661 | B1 * | 1/2002 | van Deurzen et al. | 510/302 |
| 6,653,271 | B2 * | 11/2003 | Hage et al. | 510/312 |
| 6,689,732 | B1 * | 2/2004 | Guedira et al. | 510/302 |
| 6,995,129 | B2 | 2/2006 | Olson et al. | |
| 7,056,874 | B2 | 6/2006 | Tadrowski et al. | |
| 7,169,192 | B2 | 1/2007 | Fine et al. | |
| 7,179,779 | B1 * | 2/2007 | Hauser et al. | 510/313 |
| 7,196,044 | B2 | 3/2007 | Smith et al. | |
| 2002/0010121 | A1 * | 1/2002 | Van Deurzen et al. | 510/309 |
| 2002/0013246 | A1 * | 1/2002 | Hermant et al. | 510/302 |
| 2004/0127381 | A1 * | 7/2004 | Scialla et al. | 510/372 |
| 2004/0147423 | A1 * | 7/2004 | Scialla et al. | 510/372 |

* cited by examiner

*Primary Examiner* — Gregory R Delcotto
(74) *Attorney, Agent, or Firm* — Patterson Thuente Pedersen, P.A.

(57) ABSTRACT

A method of treating a fabric using an effective amount of a two component system comprising: i) a source of peroxy bleach; and ii) a source of peroxy bleach activator in liquid form where the two components are mixed at the time and location of use to form an activated peroxy bleaching system.

8 Claims, No Drawings

BLEACHING METHODS WITH PEROXY COMPOUNDS

CROSS-REFERENCES TO RELATED APPLICATIONS

This application claims priority under 35 U.S.C. §1.19 (e) to, and hereby incorporates by reference, U.S. Provisional Application No. 61/009,544, filed Dec. 27, 2007.

BACKGROUND OF THE INVENTION

Peroxy compounds such as hydrogen peroxide, sodium perborate, sodium percarbonate, sodium persulfate, sodium perphosphate, peroxyacetic acid and numerous organic peroxides are well known for their ability to release peroxide in solution, which is useful for bleaching stains in laundry, food handling areas, and other industrial and institutional applications. These compounds can also exhibit antimicrobial properties. While solutions of these compounds exhibit these properties, many stains and microbes resist the effect of peroxide and are therefore ineffective in some situations.

Adding a bleach activator to peroxy compounds will enhance the effectiveness of the peroxy species to improve the bleaching and antimicrobial properties of the peroxy compound.

The standard in the industry for bleach activators is tetraacetylethylenediamine ("TAED"). TAED is commonly used to enhance the cleaning and bleaching effectiveness of peroxy compounds and is a component of many powdered and solid products. It is, however, only used in the form that it is supplied from the manufacturers, that is, the powdered or granular form. In the solid powdered or granular form TAED cannot be pumped by a liquid dispensing system, which is most commonly used in industrial and institutional laundry operations and in destaining items in food handling areas. This limitation greatly limits the usefulness of TAED. If an activator such as TAED could be pumped to its location of use, it would greatly enhance the effectiveness of peroxy bleaches in industrial and institutional use.

Safety, savings and environmental benefits would be therefore achieved if TAED could be added as a liquid through an automatic dispensing system.

SUMMARY OF THE INVENTION

There is provided a method of treating a fabric, the method comprising using an effective amount of a two component system, the two component system comprising a peroxy compound and a liquid peroxy bleach activator. The peroxy compound and the peroxy bleach activator may be mixed to form an activated peroxy bleaching system. The method may further include immersing the fabric in a wash solution containing the bleaching system. The peroxy compound may comprise a peroxy bleach. The peroxy bleach may include a peroxide, a perborate, a percarbonate, a persulfate, a perphosphate, a peracetic acid, or a benzoyl peroxide. The peroxy activator may include a liquid aqueous solution, which may be a solution, a slurry or a suspension. Application of the peroxy activator may improve the bleaching, cleaning, or antimicrobial effectiveness over the use of the peroxy compound alone. The peroxy activator may include tetraacetylethylenediamine (TAED). The TAED may be fluidized and may be solubilized in water by adding an alkaline material to a water-TAED mixture. The source of alkalinity may be a hydroxide of lithium, sodium, potassium, magnesium, or calcium, or may be an ammonium ion. The liquid peroxy bleach activator may include between about 60.0% and 99.8% water by weight, 0.1% and 20% TAED by weight, and/or 0.1% and 20% liquid NaOH by weight. The peroxy compound may be in a liquid, dry, or powdered form. The peroxy compound may also include hydrogen peroxide, optionally present in a concentration between about 1% and 50% by weight, between about 10% and 35% by weight, or between about 20% and 35% by weight.

There is also provided a method of treating a hard surface by mixing a peroxy bleach with a liquid bleach activator at the time of use in applying a resulting solution to the surface to be claimed.

There is further provided a liquid peroxy bleach activator, comprising TAED dissolved in an alkaline aqueous solution. The bleach activator may comprise between about 60% and 99.8% water by weight, between about 0.1% and 20% TAED by weight, and between about 0.1% and 20% dissolved alkaline substance by weight. The alkaline substance may comprise an ammonium ion or a hydroxide of lithium, sodium, potassium, magnesium, or calcium.

DETAILED DESCRIPTION OF THE INVENTION

This invention provides a liquid peroxy activator which can be mixed with a source of peroxy bleach such that the liquid activator can be pumped through a dispensing system at the time of use.

One of the components of this invention is a peroxy containing compound including, but not limited to, hydrogen peroxide, sodium perborate, sodium percarbonate, sodium persulfate, sodium perphosphate, benzoyl peroxide or any organic (i.e., carbon-containing) peroxy compound that releases oxygen when in aqueous solution. While hydrogen peroxide is supplied as an aqueous liquid in standard concentrations up to nominally 50% active, the other peroxy compounds may be dissolved or suspended in water to provide a peroxy species in a pumpable solution/suspension. Now in a liquid form, the peroxy solution/suspension can be automatically added via a dispensing device.

The second component of this invention is a bleach activator, previously defined as any compound added to a peroxy solution to increase its effectiveness. Typical use conditions for effective use of peroxy bleaches can be as high as 190 degrees F and a pH of 12 or higher. Using an activator of this invention allows the use conditions to be less aggressive, i.e., below 150 deg. F and pH levels below 11.0 yet obtaining equal results compared to bleaching with peroxide alone or with sodium hypochlorite. Washing and bleaching in milder conditions saves energy, is less harmful to the objects being cleaned and provides a safer environment for workers.

The most commonly used peroxy bleach activator is TAED. TAED is commercially available only in powdered form and cannot be, therefore, pumped automatically into its final use application. TAED is found in powdered in solid detergents, usually being co-mixed together with a dry peroxy compound. Having the two powdered/granular forms of both components in one product differs from the present invention in that, in the present invention, the bleach activator is available in a liquid form so it can be pumped into a washing machine, reservoir, or spray device as two separate distinct products.

The difficulty overcome by this invention is that TAED is only slightly soluble in water and other liquids that would be acceptable for use in cleaning solutions. I have found the solubility of TAED can be greatly increased by adding an alkaline substance to the water/TAED solution. In doing so, the concentration of TAED can be increased to over 20% by weight in an aqueous solution. The preferred alkaline materials include, but are not limited to, the hydroxides of lithium, sodium, potassium, magnesium, or calcium or to the ammonium ion.

Example 1

The procedure for the manufacture of one embodiment of the concentrated TAED solution of this invention introduced 60% by weight water into a mixing vessel, added 20% by weight TAED powder/granular material with good agitation, then 20% by weight sodium hydroxide (50% liquid as supplied) was added, the contents of the vessel were then mixed and mixing until the TAED dissolved into a clear to slightly hazy solution.

Example 2

A sample of the TAED solution from Example 1 was tested on an actual wash load of linens. The washing machine was a 50 lb capacity front-loading commercial type washing machine. During the bleaching cycle 2 oz of hydrogen peroxide and 0.5 oz of the TAED solution were added to the bleaching cycle. After the wash cycle was complete, the linens were examined for stain removal. This system was found to be as effective as peroxide bleaching and hypochlorite bleaching at higher temperatures and pH's.

Example 3

A liquid slurry of TAED was made by adding granular TAED to water with vigorous agitation to produce a fluid/liquid form of TAED that could also be pumped through a dispensing device to its final use application. While this was not as useful as the true solution of TAED for some applications, it did allow for dispensing, although it required the slurry to be continuously vigorously mixed to prevent TAED granules from settling in the mix vessel.

Example 4

The above solutions of TAED were added to the cycle of the washer of Example 2 through a peristaltic pump, although any suitable pump could have been used.

In larger cleaning operations, it is often the practice to pump cleaning chemicals into a flush system to have the chemicals flushed to the final use area with running water which enables the pumps to be placed at remote locations relative to the final use location. Solutions can also be fed to a cleaning system by gravity as long as the cleaning compounds are fluid and liquid.

Powdered or granular sources of peroxy bleach can be added to a cleaning system with the liquid activator being pumped in as a separate ingredient into the final use application. This would allow for a product to contain a peroxy bleach source that is activated only at the time of use with the liquid activator.

Example 5

Test swatches of 1"×1" were stained with blood and subjected to bleaching with various ratios of hydrogen peroxide, 35%, to the liquid TAED activator of Example 1. Beneficial results were observed with ratios from 1 part hydrogen peroxide to 5 parts of the TAED solution through a ratio of 20 parts hydrogen peroxide to 1 part TAED solution.

Example 6

Applying a water solution of 1 part hydrogen peroxide to 0.5 parts of the TAED solution of Example 1 was poured onto a coffee stain on a table and effectively removed the stain.

Peracetic acid has been used to effectively treat fabrics for stain removal and antibacterial efficacy. It has significant health hazards involved with such applications. Contact with Peracetic can cause severe and permanent tissue damage and blindness. Use of the current invention overcomes these safety issues in that the hazard is only as severe as the hydrogen peroxide that was previously used but with the increased effectiveness afforded to the cleaning operation. While no more hazardous that hydrogen peroxide it is as effective as peracetic acid in cleaning or bleaching.

What is claimed:

1. A method of activating a peroxy bleaching compound for treating a fabric, the method comprising:

i) providing a peroxy bleaching compound wherein the peroxy bleaching compound is selected from the group consisting of a peroxide, a perborate, a percarbonate, a persulfate, a perhosphate, a benzoyl peroxide, and combinations thereof, ii) providing a liquid peroxy bleach activator, wherein the liquid peroxy bleach activator consists of between about 60 percent to 99.8 percent water by weight, between about 0.1 percent to 20.0 percent tetraacetyl ethylenediamine (TAED), and between about 0.1 percent to 20.0 percent NaOH by weight;

iii) combining the peroxy bleaching compound and the liquid peroxy bleach activator at a time of use by dispensing the liquid peroxy bleach activator through an automatic liquid dispensing unit into contact with the peroxy bleaching compound to form an activated peroxy bleaching system; and iv) treating the fabric with the activated peroxy bleaching system by immersing the fabric in a wash solution containing the activated peroxy bleaching system.

2. The method of claim 1, wherein the liquid peroxy bleach activator enhances the ability of the peroxy bleaching compound to form a peroxide species in an aqueous solution.

3. The method of claim 1, wherein the liquid peroxy bleach activator improves the bleaching, cleaning and/or antimicrobial effectiveness over the use of the peroxy bleaching compound alone.

4. The method of claim 1, wherein the peroxy bleaching compound is hydrogen peroxide present in an amount between about 1 percent and 50 percent by weight.

5. The method of claim 4, wherein the hydrogen peroxide is present in an amount between about 10 percent and 35 percent by weight.

6. The method of claim 5, wherein the hydrogen peroxide is present in an amount between about 20 percent and 35 percent by weight.

7. The method of claim 1, wherein the peroxy bleaching compound is added to a washing machine and the liquid peroxy bleach activator is added separately into the washing machine via the automatic liquid dispensing unit.

8. The method of claim 1, wherein the peroxy bleaching compound and the liquid peroxy bleach activator are combined at a common location and pumped or flushed together into a washing machine.

* * * * *